US009416780B2

(12) United States Patent
Steele

(10) Patent No.: US 9,416,780 B2
(45) Date of Patent: Aug. 16, 2016

(54) ELECTROFORMED STATOR TUBE FOR A PROGRESSING CAVITY APPARATUS

(71) Applicant: Halliburton Energy Services, Inc., Houston, TX (US)

(72) Inventor: David Joe Steele, Arlington, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 46 days.

(21) Appl. No.: 14/108,673

(22) Filed: Dec. 17, 2013

(65) Prior Publication Data

US 2014/0178235 A1 Jun. 26, 2014

Related U.S. Application Data

(63) Continuation of application No. 12/523,619, filed as application No. PCT/US2007/002076 on Jan. 24, 2007, now Pat. No. 8,636,485.

(51) Int. Cl.

| | |
|---|---|
| ***F01C 1/10*** | (2006.01) |
| ***F03C 2/00*** | (2006.01) |
| ***F03C 4/00*** | (2006.01) |
| ***F04C 2/00*** | (2006.01) |
| ***F04C 2/107*** | (2006.01) |

(Continued)

(52) U.S. Cl.

CPC ..... *F04C 2/1075* (2013.01); *C25D 1/00* (2013.01); *C25D 1/02* (2013.01); *F04C 2/1071* (2013.01); *F04C 2/1073* (2013.01); *F04C 2230/101* (2013.01); *F04C 2230/20* (2013.01); *F04C 2230/91* (2013.01); *F04C 2230/92* (2013.01); *Y10T 29/49242* (2015.01)

(58) Field of Classification Search

CPC ..... C25D 1/00; C25D 1/02; C25D 1/10; F04C 2/1071; F04C 2/1073; F04C 2/1075; F04C 2230/10; F04C 2230/101; F04C 2230/20; F04C 2230/91; F04C 2230/92; F01C 21/0809; Y10T 29/49242

USPC ..... 418/48, 152–153, 178–179; 29/888.023, 888.044, 890.054, 888.02; 205/67, 73

See application file for complete search history.

(56) References Cited

U.S. PATENT DOCUMENTS

| | | | |
|---|---|---|---|
| 1,892,217 | A | 12/1932 | Moineau |
| 4,080,268 | A | 3/1978 | Suzuki et al. |

(Continued)

FOREIGN PATENT DOCUMENTS

| | | | |
|---|---|---|---|
| CA | 2315043 | A1 | 6/1999 |
| CA | 2271647 | A1 | 11/1999 |

(Continued)

OTHER PUBLICATIONS

"U.S. Appl. No. 12/523,619 , Response filed Mar. 27, 2013 to Non Final Office Action mailed Sep. 27, 2012", 15 pgs.

(Continued)

*Primary Examiner* — Theresa Trieu

(74) *Attorney, Agent, or Firm* — Schwegman, Lundberg & Woessner, P.A.; Alan Bryson

(57) ABSTRACT

A method for use in producing a stator for a progressing cavity apparatus which includes the use of electroforming to produce the stator tube. A stator tube for a progressing cavity apparatus which is produced using electroforming and a stator for a progressing cavity apparatus which includes a stator tube produced using electroforming.

12 Claims, 11 Drawing Sheets

(51) Int. Cl.

| | |
|---|---|
| ***C25D 1/00*** | (2006.01) |
| ***C25D 1/02*** | (2006.01) |

(56) References Cited

U.S. PATENT DOCUMENTS

| | | | | |
|---|---|---|---|---|
| 4,235,691 | A | 11/1980 | Loqvist | |
| 4,461,678 | A | 7/1984 | Matthews et al. | |
| 4,650,549 | A | 3/1987 | Morgan | |
| 5,145,342 | A | 9/1992 | Gruber | |
| 5,145,343 | A | 9/1992 | Belcher | |
| 5,171,138 | A | 12/1992 | Forrest | |
| 6,158,988 | A | 12/2000 | Jäger | |
| 6,162,032 | A | 12/2000 | Jäger | |
| 6,293,358 | B1 | 9/2001 | Jäger | |
| 6,309,195 | B1 | 10/2001 | Bottos et al. | |
| 6,336,796 | B1 | 1/2002 | Cholet et al. | |
| 6,409,902 | B1 | 6/2002 | Yang et al. | |
| 6,427,787 | B1 | 8/2002 | Jäger | |
| 6,543,132 | B1 | 4/2003 | Krueger et al. | |
| 6,568,076 | B2 | 5/2003 | Bottos et al. | |
| 6,604,921 | B1 | 8/2003 | Plop et al. | |
| 6,604,922 | B1 | 8/2003 | Hache | |
| 6,666,668 | B1 | 12/2003 | Kaechele | |
| 6,716,008 | B1 * | 4/2004 | Kachele | 418/48 |
| 6,872,061 | B2 | 3/2005 | Lemay et al. | |
| 8,636,485 | B2 | 1/2014 | Steele | |
| 2007/0252461 | A1 | 11/2007 | Komori | |
| 2010/0086425 | A1 | 4/2010 | Steele | |

FOREIGN PATENT DOCUMENTS

| | | | |
|---|---|---|---|
| CA | 2333948 | A1 | 12/1999 |
| CA | 2387833 | A1 | 4/2001 |
| CA | 2409054 | A1 | 4/2004 |
| CA | 2412209 | A1 | 5/2004 |
| WO | WO-2008091262 | A1 | 7/2008 |

OTHER PUBLICATIONS

"U.S. Appl. No. 12/523,619, Final Office Action mailed May 20, 2013", 11 pgs.
"U.S. Appl. No. 12/523,619, Non Final Office Action mailed Sep. 27, 2012", 9 pgs.
"U.S. Appl. No. 12/523,619, Notice of Allowance mailed Sep. 18, 2013", 6 pgs.
"U.S. Appl. No. 12/523,619, Response filed Aug. 20, 2013 to Final Office Action mailed May 20, 2013", 6 pgs.
Graham, A. K, "Electroplating Engineering Handbook 3rd ed", (1971), 520.
"International Application Serial No. PCT/US2007/002076, International Preliminary Report on Patentability mailed Aug. 6, 2009", 10 pgs.
"International Application Serial No. PCT/US2007/002076, International Search Report mailed Oct. 22, 2007", 4 pgs.
"International Application Serial No. PCT/US2007/002076, Written Opinion mailed Oct. 22, 2007", 10 pgs.
"Singaporean Application Serial No. SG 200808148-1, Examination Report mailed Nov. 24, 2009", 6 pgs.

* cited by examiner

ELECTROFORMED STATOR TUBE FOR A PROGRESSING CAVITY APPARATUS

RELATED APPLICATION

This application is a Continuation application of U.S. patent application Ser. No. 12/523,619, filed Dec. 1, 2009 which application is a nationalization under 35 U.S.C. 371 of PCT/US2007/002076, filed Jan. 24, 2007 and published as WO 2008/091262 A1, on Jul. 31, 2008; which applications and publication are incorporated herein by reference in their entirety and made a part hereof.

TECHNICAL FIELD

A method for producing a stator tube for a progressing cavity apparatus using electroforming and a stator tube for a progressing cavity apparatus which is produced using electroforming.

BACKGROUND

Progressing cavity apparatus include progressing cavity motors and progressing cavity pumps.

A progressing cavity motor is frequently used to drive a drill bit in borehole drilling operations, such as operations to drill an oil and/or gas well. A progressing cavity motor receives energy from a fluid passing through the motor and converts the fluid energy to rotational energy of the drill bit.

A progressing cavity pump is frequently used to pump fluids from a borehole, such as a producing well. A progressing cavity pump receives rotational energy from a motor which is typically located at the surface of the borehole and transfers the rotational energy to a fluid which has accumulated in the pump and/or the borehole, so that the fluid energy conveys the fluid to the surface of the borehole.

Progressing cavity apparatus, including progressing cavity motors and progressing cavity pumps, are often referred to as "Moineau" apparatus, in recognition of their inventor, Rene Moineau, who obtained U.S. Pat. No. 1,892,217 for a "Gear Mechanism" on Dec. 27, 1932.

Progressing cavity apparatus are characterized by a stator and a rotor, wherein the rotor is disposed within the stator and rotates within the stator.

The stator has a helical lobed stator profile on an inner surface of the stator and the rotor has a helical lobed rotor profile on an outer surface of the rotor. Each lobe defines a separate helix or thread which winds along the length of the stator or rotor. The stator has one more lobe than the rotor. The respective pitches (i.e., the longitudinal distance required for a lobe to wind one full turn around the length of the stator or rotor) of the lobes on the stator and rotor are in the same ratio as the number of lobes on the stator and the rotor respectively. For example, if the stator has three lobes, the rotor will have two lobes and the ratio of the pitch of the lobes on the stator to the pitch of the lobes on the rotor will be 3:2.

Another feature of progressing cavity apparatus is that each lobe of the rotor is constantly in contact with the stator at any transverse cross section. This has the effect of creating a plurality of empty spaces between the stator and the rotor which each have a length equal to the pitch of the stator. The number of empty spaces is equal to the number of lobes on the stator. The empty spaces are isolated from each other by the points of contact between the rotor and the stator, which are often referred to as "seal lines".

The empty spaces between the stator and the rotor may be repeated in "stages" along the length of the progressing cavity apparatus, wherein a stage is defined by one full rotation of the stator lobes. As a result, a progressing cavity apparatus which includes a stator having a length equal to two times the pitch of the stator lobes is described as a two-stage progressing cavity apparatus.

As the rotor rotates within the stator, the empty spaces "move" or progress with a helical motion along the length of the apparatus. In the operation of a progressing cavity motor, these empty spaces are filled with a drive fluid which causes the rotor to rotate relative to the stator as the empty spaces move from one end of the stator to the other end of the stator. In the operation of a progressing cavity pump, these empty spaces are filled with a driven fluid which is caused to move from one end of the stator to the other end of the stator as the rotor rotates relative to the stator.

Due to the shape and geometry of the stator and the rotor, the rotor will move laterally or precess relative to the stator as the rotor rotates within the stator. In other words, the rotor moves eccentrically relative to the stator in addition to rotating within the stator.

The performance characteristics of a progressing cavity apparatus are dependent upon design parameters such as the diameters of the stator and the rotor, the number of lobes on the stator and the rotor, the pitch of the stator and the rotor, the amount of eccentricity between the stator and the rotor, and the overall length or number of stages of the apparatus.

For example, increasing the number of stages of a progressing cavity apparatus generally increases the torque capacity/pressure capacity of the apparatus and increasing the number of lobes on the stator and the rotor generally increases the volumetric capacity of a progressing cavity apparatus as well as the torque capacity/pressure capacity of the apparatus.

The performance characteristics of a progressing cavity apparatus are also dependent upon the ability of the apparatus to provide an effective seal between the rotor and the stator along the seal lines.

For example, the torque capacity/pressure capacity of a progressing cavity apparatus is proportional to the differential pressure which can be developed between the ends of the apparatus, which in turn is dependent upon the effectiveness of the seal between the rotor and the stator along the seal lines.

In order to accommodate the complex movement of the rotor relative to the stator while maintaining effective sealing along the seal lines between the rotor and the stator, stators are typically of a composite construction which includes a metal stator tube having a lining of an elastomeric material applied to an inner surface of the stator tube.

In a conventional progressing cavity apparatus, the stator tube is comprised of a cylindrical tubular member having a cylindrical tube profile on its inner surface, so that the helical lobed stator profile is provided solely by the elastomeric material. As a result, the thickness of the elastomeric lining varies considerably along the transverse cross-section of the stator. Where the elastomeric material defines a lobe it is relatively thick and where the elastomeric material defines a space between lobes it is relatively thin.

The torque capacity/pressure capacity and overall integrity of a progressing cavity apparatus is limited by the strength and durability of the elastomeric lining. The lining must be rigid enough to resist the pressure differential between adjacent empty spaces, must be flexible enough to accommodate the complex relative movement of the rotor and the stator, and must be able to withstand high temperatures, temperature fluctuations, repeated cycles of deformation, and the wearing effects of solids which may be contained in the fluid which passes through the apparatus. The lining must also resist the effects of physical and chemical interactions with substances which may come into contact with the lining.

Although the conventional progressing cavity apparatus is relatively effective, it has been found that the elastomeric lining provides a general weak link in the performance, reliability and durability of conventional progressing cavity apparatus. For example, elastomeric materials tend to exhibit a significantly higher heat capacity than metals, with the result that elastomeric linings tend to absorb and retain significant amounts of heat during operation of the apparatus, particularly in the areas where the elastomeric lining defines lobes and is therefore relatively thicker. Elastomeric materials are also prone to swelling due to heat or interactions with substances which come into contact with them, which swelling becomes more pronounced as the thickness of the elastomeric lining increases.

As a result, efforts have been made to improve the materials which are used to provide the elastomeric lining. Efforts have also been made to improve upon the conventional stator configuration in order to minimize the limitations of the elastomeric lining.

These latter efforts have resulted in the development of "high performance" progressing cavity apparatus.

In a high performance progressing cavity apparatus, the inner surface of the stator tube has a helical lobed tube profile. Depending upon how the stator tube is fabricated, the outer surface of the stator tube may be generally cylindrical or may have a helical lobed profile which substantially matches the helical lobed tube profile on the inner surface of the stator tube.

A relatively thin and substantially constant thickness of an elastomeric material is typically applied to the inner surface of the stator tube (i.e., the helical lobed tube profile) as a lining. Where the outer surface of the stator tube has a helical lobed profile which substantially matches the helical lobed tube profile on the inner surface of the stator tube, the stator tube itself may also have a substantially constant thickness.

It has been found that high performance progressing cavity apparatus can provide superior torque capacity/pressure capacity and improved reliability and durability in comparison with conventional progressing cavity apparatus.

For example, the relatively thin and substantially constant thickness of the elastomeric lining which is made possible by providing the helical lobed tube profile on the inner surface of the stator tube facilitates an improved seal between the rotor and the stator. In addition, the reduced thickness of the elastomeric lining has been found to provide superior heat dissipation and less swelling due to physical and/or chemical interactions with substances which may be contained in fluids which pass through the apparatus.

The prior art contains descriptions of high performance progressing cavity apparatus and descriptions of methods for fabricating stators for high performance progressing cavity apparatus.

U.S. Pat. No. 5,145,342 (Gruber) describes several designs for a stator, each of which purports to include a uniform layer thickness of a rubber-elastic insert material. In one embodiment, the stator tube has a helical lobed profile on both its inner and outer surfaces. In a second embodiment, the stator tube has a cylindrical profile on both its inner and outer surfaces, but metal wires are embedded in the rubber-elastic insert material along the lobes in order to maintain the uniform layer thickness of the rubber-elastic insert material. The stator tube is described as being manufactured in a known manner.

U.S. Pat. No. 5,145,343 (Belcher) describes a progressing cavity pump in which the stator is provided with a substantially constant wall thickness of an elastomeric lining.

U.S. Pat. No. 5,171,138 (Forrest) describes a composite stator for a progressing cavity motor which includes a housing, a rigid metal stator former secured within the housing and having a multi-lobed helical inner surface and a uniform thickness wall, and an elastomeric material having a substantially uniform thickness applied to the helical inner surface of the stator former. The space between the stator former and the housing may be filled with additional elastomer or with resin in order to support the stator former within the housing.

U.S. Pat. No. 6,158,988 (Jager), U.S. Pat. No. 6,162,032 (Jager), U.S. Pat. No. 6,427,787 (Jager) and Canadian Patent Application No. 2,271,647 (Jager) all describe progressing cavity apparatus which include a lining of an elastomeric material with an essentially uniform thickness and a stator tube with a helical lobed profile on both its inner surface and outer surface so that it also has a substantially uniform thickness.

U.S. Pat. No. 6,293,358 (Jager) describes a progressing cavity apparatus which includes an outer tubular member, a replaceable thin-walled inner tubular member extending within the outer tubular member and supported by the outer tubular member, and a liner attached to the inner wall of the inner tubular member. The thin-walled inner tubular member has a helical lobed profile on both its inner surface and outer surface and is described as being produced from thin walled cylindrical pipes using a permanent deformation process according to known methods.

U.S. Pat. No. 6,309,195 (Bottos et al), U.S. Pat. No. 6,568,076 (Bottos et al) and Canadian Patent No. 2,333,948 (Bottos et al) all describe a stator for a progressing cavity apparatus which includes a thick walled stator tube having a helical lobed profile on its inner profile and a matching helical lobed profile on its outer profile, and a constant thickness of an elastomer layer molded or attached to the inner profile of the stator tube. It is described that the constant thickness of the elastomer layer results in less heat generation and less swelling in aggressive drilling fluids and at higher temperatures. It is further described that the matching inner profile and inner profile of the stator tube results in the stator tube always being proximate to the sealing surface, thus reinforcing the elastomer layer and facilitating a substantial dissipation of heat due to the superior heat conducting properties of metal in comparison with the elastomer material. Furthermore, because the stator is thick walled, it is not necessary to provide a separate supporting housing for the stator tube.

U.S. Pat. No. 6,309,195 (Bottos et al), U.S. Pat. No. 6,568,076 (Bottos et al) and Canadian Patent No. 2,333,948 (Bottos et al) also describe three manufacturing methods for the stator tube. A first manufacturing method is a rolling method in which a cylinder or tube is rolled over a metal core having a helical lobed profile. A second manufacturing method is a cold drawing method in which a swaged metal tube is pulled through a pair of rotatable dies which form the helical lobed profile on the inner surface and the outer surface of the stator tube. A third manufacturing method is a hot extrusion method in which a hot metal cylinder is forced through a pair of dies, each having a helical lobed shape.

U.S. Pat. No. 6,543,132 (Krueger et al) and Canadian Patent No. 2,315,043 (Krueger et al) both describe a number of manufacturing methods for producing stator tubes for a progressing cavity motor which have a helical lobed profile on their inner surface and a cylindrical profile on their outer surface. In a first manufacturing method, a mandrel having a helical lobed profile is disposed within a metal tubular member and the tubular member is placed between at least two rollers which rotate in opposite directions, thereby moving the tubular member in the same direction. The rollers rotate back and forth, thereby providing a stroking motion to the tubular member. The method is continued until the inner surface of the tubular member attains the helical lobed profile of the mandrel. In a second manufacturing method, the stator tube is formed by compressing a tubular member by a plurality of continuously rolling rollers until the inner surface of the tubular member attains the helical lobed profile of a mandrel which has been placed inside the tubular member. In a third manufacturing method, a tubular member having therein a mandrel with a helical lobed profile is alternately pressed with a plurality of dies disposed around the outer surface of the tubular member until the inner surface of the tubular member attains the helical lobed profile of the mandrel. In a fourth manufacturing method, metal is sprayed to a desired thickness onto a frangible mandrel having a helical lobed profile, following which the mandrel is removed from the tubular member.

U.S. Pat. No. 6,604,921 (Plop et al) and U.S. Pat. No. 6,604,922 (Hache) both describe a stator tube for a progressing cavity motor which has a helical lobed profile on its inner surface and a cylindrical profile on its outer surface. A liner formed from a material such as an elastomer is applied to the inner surface of the stator tube, which liner has an "optimized" variable thickness. It is described that the helical lobed profile of the stator tube may be shaped by any means known in the art including machining, extrusion and the like.

U.S. Pat. No. 6,666,668 (Kaechele), U.S. Pat. No. 6,716,008 (Kachele) and Canadian Patent Application No. 2,387,833 (Kachele) all describe a stator for a progressing cavity apparatus which include a stator tube with a helical lobed profile on its inner surface and its outer surface, thereby providing a constant wall thickness of the stator tube, and a lining applied to the inner surface of the stator tube, which lining also has a constant wall thickness.

U.S. Pat. No. 6,872,061 (Lemay et al) describes a method for making a stator for a progressing cavity pump, wherein the stator tube is a rigid-walled metal tube having a helical lobed profile on both its inner surface and its outer surface. The shape of the stator tube is formed by subjecting metal tube to a preliminary mechanical-forming step to preform a rough shape followed by a definitive-forming step during which the rough shape is subjected to a hydroforming process. The formed stator tube is then mounted within an outer casing which forms a housing for the stator tube.

Canadian Patent Application No. 2,409,054 (Kaiser et al) and Canadian Patent Application No. 2,412,209 (Kaiser et al) both describe a hydroforming process for forming a stator tube for a progressing cavity apparatus in which a tube is placed in a hydroforming fixture and then subjected to a hydroforming process to produce a stator tube which has a helical lobed profile on both its inner surface and its outer surface. These patent applications contemplate a thin walled embodiment of a stator tube in which the stator tube is mounted inside a support housing and a thick walled embodiment in which the support housing is omitted.

Electroforming is effectively a variation of a conventional electroplating process. Both electroplating and electroforming involve electrodeposition of metal onto a cathode in an electrolytic cell. However, while electroplating typically results in the electrodeposition of relatively thin coatings on a supporting object, electroforming can result in the electrodeposition of much thicker coatings which can exist as a self supporting structure. As a result, electroforming may be used for the production of metal parts which must exhibit structural strength and integrity.

In electroforming, a conductive mandrel having a desired mandrel profile on its outer surface is first provided as a cathode in a suitable electrolytic cell. Metal is electrodeposited onto the outer surface of the mandrel to a desired thickness and then the mandrel is separated from the deposited metal, leaving a metal "shell" which has a profile on its inner surface which matches the mandrel profile.

For some mandrel profiles, the mandrel may be separated from the deposited metal simply by extracting the mandrel from the deposited metal shell. For other mandrel profiles which do not permit extraction of the mandrel, the mandrel may be separated from the deposited metal by melting the mandrel, by dissolving the mandrel, or by otherwise destroying the mandrel.

Electroforming enables the production of metal pieces having complex internal shapes which may otherwise be difficult to manufacture. Electroformed metal exhibits superior material properties, since electroformed metal is deposited in layers with a fully developed fine grained structure. Finally, electroforming is very precise and can therefore reproduce the mandrel profile virtually exactly, without the shrinkage and distortion which may be associated with other metal forming techniques, such as casting, stamping, rolling, drawing, extruding etc.

Because electroforming is effectively an electroplating process, the selection of the metal to be deposited and the components of the electrolytic cell (including the electrodes, the power supply, and the temperature and composition of the electrolytic bath) may be made in a similar manner as in a conventional electroplating process.

U.S. Pat. No. 4,461,678 (Matthews et al) describes the manufacture of a jet pump using an electroforming process, in which the electroforming mandrel consists of a mandrel assembly including a plurality of interconnected forming mandrels, which forming mandrels may be disconnected from each other in order to separate the mandrel assembly from the electrodeposited metal shell which results from the electroforming process.

U.S. Pat. No. 6,409,902 (Yang et al) describes a rapid tooling process which integrates solid freeform fabrication (SFF) with electroforming to produce metal tools including molds, dies, and electrical discharge machining (EDM) electrodes. Solid freeform fabrication is first used to produce a rapid prototyping master and a conforming anode. Electroforming is then used to electrodeposit a layer of metal onto the rapid prototyping master to form a cathode shell on the rapid prototyping master. Finally, the rapid prototyping master is removed from the cathode shell.

The prior art described above does not describe, suggest or contemplate the use of electroforming for the manufacture of stator tubes for use in progressing cavity apparatus.

SUMMARY

The present invention is directed at a method for use in producing a stator for a progressing cavity apparatus. The present invention is also directed at a stator tube and at a stator comprising a stator tube.

A method of the invention involves the use of electroforming to produce a stator tube. The stator tube of the invention may be comprised of an electroformed deposit of a deposited metal. The stator of the invention is comprised of a stator tube which may be comprised of an electroformed deposit of a deposited metal.

In one embodiment, the invention is a method for use in producing a stator for a progressing cavity apparatus, the method comprising:

(a) providing a stator tube electroforming mandrel;

(b) incorporating the stator tube electroforming mandrel into an electrolytic cell so that a cathode of the electrolytic cell is comprised of the stator tube electroforming mandrel;

(c) electrodepositing a thickness of a deposited metal onto the stator tube electroforming mandrel as an electroformed deposit;

(d) removing the stator tube electroforming mandrel from the electrolytic cell; and (e) separating the stator tube electroforming mandrel from the electroformed deposit, thereby producing a stator tube, wherein the stator tube is comprised of the electroformed deposit.

Another embodiment includes a stator tube for a progressing cavity apparatus, wherein the stator tube is comprised of an electroformed deposit of a deposited metal.

Yet another embodiment includes a stator for a progressing cavity apparatus, the stator comprising a stator tube comprising an electroformed deposit of a deposited metal, wherein the stator tube has an inner surface and wherein the inner surface of the stator tube has a helical lobed tube profile.

The progressing cavity apparatus may be comprised of any machine which includes a rotor having a helical lobed rotor profile which is disposed within a stator having a helical lobed stator profile. For example, the progressing cavity apparatus may be comprised of a progressing cavity motor or a progressing cavity pump.

The progressing cavity apparatus may or may not include an elastomeric lining applied to the outer surface of the rotor and/or to the inner surface of the stator tube. For example, an elastomeric lining may not be required if the stator tube is sufficiently elastic and resilient to be able to accommodate the complex motion of the rotor while still permitting an effective seal between the rotor and the stator tube. The progressing cavity apparatus may include an elastomeric lining and preferably the elastomeric lining is applied directly or indirectly to the inner surface of the stator tube.

The elastomeric lining may be comprised of any material or combination of materials which are suitable for providing a resilient lining for a progressing cavity apparatus. The elastomeric lining may be comprised of rubber. The rubber may be comprised of a nitrile rubber material which in turn comprises butadiene and acrylonitrile. A rubber which comprises the elastomeric lining may be a component of a rubber compound which may also be comprised of one or more reinforcing materials, curing agents, accelerators, plasticizers etc.

The progressing cavity apparatus may be a conventional progressing cavity apparatus in which the inner surface of the stator tube has a substantially cylindrical tube profile, so that the helical lobed stator profile is provided solely by the profile of the elastomeric lining. However, stator tubes for conventional progressing cavity apparatus are relatively simple to manufacture using conventional manufacturing methods, with the result that electroforming may not provide great benefits in the manufacture of stator tubes for conventional progressing cavity apparatus.

The progressing cavity apparatus may be a high performance progressing cavity apparatus in which the inner surface of the stator tube has a helical lobed tube profile, since electroforming may greatly simplify the manufacture of such stator tubes. The outer surface of the stator tube may have a helical lobed profile, a generally cylindrical profile, or some other profile.

In any event, the outer surface of the stator tube electroforming mandrel has a mandrel profile and the tube profile of the inner surface of the stator tube is complementary to the mandrel profile so that the tube profile is effectively defined by the mandrel profile. For example, if the outer surface of the stator tube electroforming mandrel has a substantially cylindrical mandrel profile, the inner surface of the stator tube has a substantially cylindrical tube profile. Similarly, if the outer surface of the stator tube electroforming mandrel has a helical lobed mandrel profile, the inner surface of the stator tube has a helical lobed tube profile. In one embodiment, the outer surface of the stator tube electroforming mandrel has a helical lobed mandrel profile so that the inner surface of the stator tube has a helical lobed tube profile which is complementary to the helical lobed mandrel profile.

The deposited metal may be comprised of any metal or combination of metals which may be electrodeposited to a required thickness onto the stator tube electroforming mandrel and which is suitable (due to its chemical and/or physical properties) for use in a stator tube. For example, the deposited metal may be comprised of copper, nickel, chromium, cobalt and/or alloys containing these metals. The deposited metal may be comprised of copper, nickel and/or alloys containing copper and/or nickel. One exemplary alloy which may be suitable for use as the deposited metal in the invention is a nickel cobalt alloy containing nickel and cobalt.

The electrolytic cell, including the composition of the electrolytic bath and the anode, is selected to be compatible with the choice of deposited metal.

The stator tube electroforming mandrel may be comprised of any material or combination of materials which is suitable for use as a cathode in an electrolytic cell, which is suitable for use as a temporary supporting structure for the deposited metal, and which can be separated from the electroformed deposit without substantially damaging the electroformed deposit.

Depending upon the circumstances and subject to the above criteria, exemplary materials which may be suitable for use in the stator tube electroforming mandrel include metal, plastic, wax and wood, as well as combinations and composites of these materials. Exemplary metals may include stainless steel, aluminum and various alloys. Exemplary plastics may include thermoplastics, poly vinyl chloride (PVC), polystyrene and polyurethane.

Suitable materials for use as a cathode in an electrolytic cell may include a conductive material or may include a non-conductive material which has been surface treated to provide a conductive coating.

Suitable materials for use as a temporary supporting structure for the deposited metal may include a material or a combination of materials which has sufficient strength and rigidity to support the deposited metal while it is being electrodeposited onto the stator tube electroforming mandrel.

Suitable materials for separation of the stator tube electroforming mandrel from the electroformed deposit are dependent upon the profile of the stator tube electroforming mandrel and the resulting stator tube and thus the manner in which the stator tube electroforming mandrel must be separated from the electroformed deposit.

If the stator tube electroforming mandrel can be separated from the electroformed deposit by being extracted from the electroformed deposit without damaging or destroying either the stator tube electroforming mandrel or the electroformed deposit, the stator tube electroforming mandrel may be constructed of a material which can withstand the extraction.

If the stator tube electroforming mandrel cannot be separated from the electroformed deposit without damaging or destroying either the stator tube electroforming mandrel or the electroformed deposit, the stator tube electroforming mandrel may be constructed of a material such that the stator tube electroforming mandrel can be sacrificed in order to separate the stator tube electroforming mandrel from the electroformed deposit.

In such circumstances, the stator tube electroforming mandrel may be dissolved, melted or is frangible so that the stator tube electroforming mandrel may be separated from the electroformed deposit by dissolving the stator tube electroforming mandrel, by melting the stator tube electroforming mandrel, or by breaking the stator tube electroforming mandrel.

The stator tube electroforming mandrel may also be collapsible or may be comprised of a plurality of mandrel sections which are independently separable from the electroformed deposit.

In some embodiments, the deposited metal is comprised of copper, nickel and/or one or more alloys containing copper and/or nickel. For example, the deposited metal may be comprised of a nickel cobalt alloy containing nickel and cobalt. The stator tube electroforming mandrel may be separated from the electroformed deposit by dissolving or melting the stator tube electroforming mandrel. The stator tube electroforming mandrel may be separated from the electroformed deposit by melting, in which case the stator tube electroforming mandrel should be comprised of a material which has a lower melting point than the electroformed deposit. The stator tube electroforming mandrel may be constructed of a material substantially comprised of aluminum and/or an alloy containing aluminum, which material has a much lower melting point than that of copper, nickel and most if not all alloys containing these metals.

The thickness of the electroformed deposit is dependent upon the requirements of the stator tube and the electrodeposition limitations of the chosen deposited metal.

As a first example, the electroformed deposit will tend to have a relatively constant thickness, since the electrodeposition of the deposited metal onto the stator tube electroforming mandrel will tend to be relatively even. As a result, if the inner surface of the electroformed deposit has a helical lobed profile, the outer surface of the electroformed deposit will tend to have a matching helical lobed profile.

If a helical lobed profile on the outer surface of the stator tube is not desired, the outer surface of the electroformed deposit or the stator tube may be formed into a substantially cylindrical shape or into some other desired shape by modifying the outer surface. The outer surface may be modified either by adding material to the outer surface or by removing material from the outer surface. The addition or removal of material may be performed either before or after the stator tube electroforming mandrel is separated from the electroformed deposit.

Material may be removed from the outer surface of the electroformed deposit by any suitable method, such as for example by machining the outer surface. If the outer surface of the electroformed deposit is to be machined, the thickness of the electroformed deposit should be sufficient to accommodate such machining and to provide a desired nominal diameter of the stator tube.

As a second example, the thickness of the electroformed deposit should be sufficient so that the stator tube will have a required strength and rigidity. If the stator will not comprise a supporting stator housing, the electroformed deposit should be thick enough so that the stator tube has sufficient strength and rigidity to withstand the stresses applied to the progressing cavity apparatus.

The stator may, however, be further comprised of a supporting stator housing so that the stator tube is mounted in the supporting stator housing. If the stator comprises a supporting stator housing, the required thickness of the electroformed deposit may be less than if no supporting stator housing is provided, since the supporting stator housing may provide all or a portion of the required strength and rigidity of the stator.

Furthermore, if the stator is comprised of a supporting stator housing, the stator tube may optionally be constructed as a "thin walled" stator tube which can accommodate some or all of the relative movement between the rotor and the stator, in which case the thickness of the elastomeric lining may be reduced or possibly eliminated altogether.

If the stator is comprised of a supporting stator housing, the stator tube may fit closely within the supporting stator housing so that the stator tube is directly supported by the supporting stator housing. Alternatively, the stator tube may fit within the supporting stator housing such that there is a clearance between the stator tube and the supporting stator housing.

The stator tube may be mounted within the supporting stator housing in any suitable manner. For example, if the stator tube is to fit closely within the supporting stator housing, a press fit or interference fit may be provided between the components. If a clearance is provided between the stator tube and the supporting stator housing, the stator tube may be mounted inside the supporting stator housing using suitable fittings, brackets, connectors etc. to form a joint or joints between the components and by using suitable fasteners or welding or electrodeposition to fasten the stator tube and the supporting stator housing together at the joints. All or portions of the outer surface of the stator tube and the inner surface of the supporting stator housing may also be provided with matching profiles to provide joints to facilitate mounting of the stator tube within the supporting stator housing.

In any case, an annular space may be defined between all or a portion of the stator tube and the supporting stator housing. A filler material may be introduced into the annular space in order to provide additional support for the stator tube within the supporting stator housing. The filler material may or may not substantially fill the annular space.

The filler material may be comprised of any suitable material or combination of materials. For example, the filler material may be comprised of a resilient material such as an elastomeric material, such as for example an elastomeric material similar to that used for the elastomeric lining. The filler material may also be comprised of a relatively rigid material, such as a cement material, such as for example a polymer cement such as an epoxy cement. A resilient filler material may facilitate some radial deformation of the stator tube while a rigid filler material will tend to inhibit radial deformation of the stator tube.

As indicated, an elastomeric lining may be applied directly or indirectly to the inner surface of the stator tube in order to assist in accommodating the complex relative movement between the rotor and the stator, unless the stator tube is sufficiently resilient to fully accommodate the relative movement. The elastomeric lining may be applied indirectly to the inner surface of the stator tube by being incorporated into a composite material sleeve which is inserted within the stator tube.

The elastomeric lining may be applied directly to the inner surface of the stator tube so that the elastomeric lining is physically or chemically attached to the inner surface of the stator tube. The elastomeric lining may be applied to the inner surface of the stator tube in any suitable manner. For example, the elastomeric lining may be applied to the inner surface of the stator tube using a process which involves inserting a form into the stator tube, injecting a lining material between the form and the inner surface of the stator tube, and then removing the form.

The elastomeric lining will define the helical lobed stator profile as a result of the shape of the form. If the inner surface of the stator tube has a cylindrical tube profile, the helical lobed stator profile will be defined solely by the elastomeric lining, with the result that the thickness of the elastomeric lining will vary throughout the transverse cross section of the progressing cavity apparatus. If the inner surface of the stator tube has a helical lobed tube profile, the helical lobed stator profile may be defined both by the helical lobed tube profile and by the elastomeric lining, since the elastomeric lining may be applied to have a substantially constant thickness if the form is configured to mirror the inner surface of the stator tube. Alternatively, in either case the shape of the form may provide a stator profile which is a variation of a helical lobed stator profile in order to obtain perceived benefits of design optimization.

The invention may be used to produce a stator tube for a progressing cavity apparatus. The invention may also be used to produce a stator for a progressing cavity apparatus, where the stator is comprise of a stator tube. The stator may be further comprised of an elastomeric lining and may be further comprised of a supporting stator housing for supporting the stator tube. The stator may also be further comprised of other structures and features of the type typically associated with stators for progressing cavity apparatus.

BRIEF DESCRIPTION OF DRAWINGS

Embodiments of the invention will now be described with reference to the accompanying drawings, in which.

DETAILED DESCRIPTION

An embodiment of the invention is directed at the use of electroforming in producing a stator tube for a progressing cavity apparatus. Some embodiments include a method for producing components of a stator for a progressing cavity apparatus, including a stator tube which has been produced using electroforming.

In some embodiments, the stator tube is intended for use in a high performance progressing cavity apparatus in which a helical lobed stator profile is provided by the stator tube. In some embodiments the helical lobed stator profile is optionally also provided by a substantially constant thickness of an elastomeric lining. In other words, in some embodiments the stator tube has a helical lobed tube profile to which may be applied a substantially constant thickness elastomeric lining.

Referring to FIGS. 4-11, stages in the production of a stator according to a first embodiment of the invention are depicted. Referring to FIGS. 12-21, stages in the production of a stator according to a second embodiment of the invention are depicted. Although the first embodiment and the second embodiment are similar in many respects, they represent at least two different exemplary possible applications of the invention.

Figure 1:
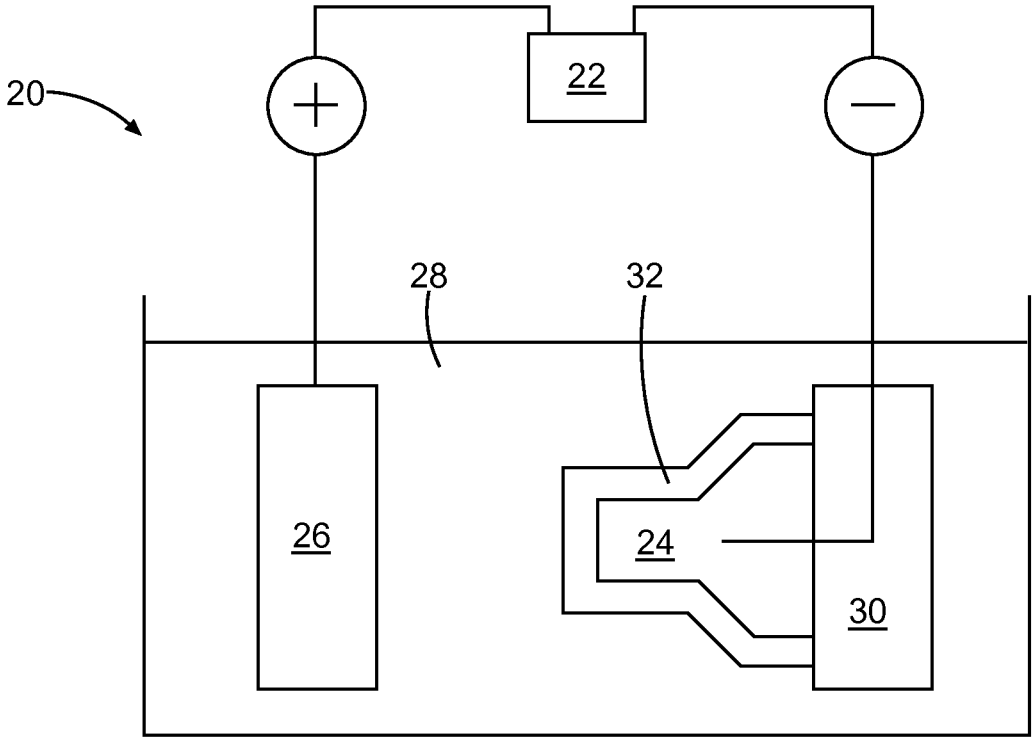
FIG. 1 is a schematic drawing of an electrolytic cell configured for electrodeposition by electroforming.
Figure 2:
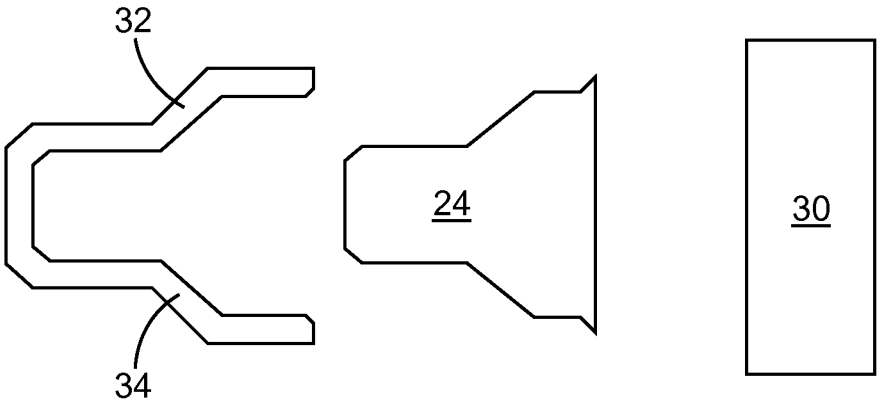
FIG. 2 is a schematic drawing depicting the separation of an electroformed deposit from an electroforming mandrel following electrodeposition of the electroformed deposit by electroforming.

In FIG. 1 and FIG. 2, a general method of electroforming and a general apparatus for performing electroforming are depicted schematically.

Referring to FIG. 1, an electrolytic cell (20) is provided for performing the electroforming. The electrolytic cell (20) includes a power supply (22) of direct current power which is connected between a cathode (24) and an anode (26) and which provides a voltage potential difference between the cathode (24) and the anode (26).

In electrolytic cells generally, the cathode (24) is conventionally considered as the (−) electrode and the anode (26) is conventionally considered as the (+) electrode. As a result, the anode (26) is more positive than the cathode (24) and electrons are constantly being circulated by the power supply (22) from the anode (26) to the cathode (24).

The electrolytic cell (20) is further comprised of an electrolytic bath (28) which provides a return conductive path between the cathode (24) and the anode (26), so that the electrolytic cell (20) forms a complete electrical circuit comprising the power supply (22), the cathode (24), the anode (26), and the electrolytic bath (28).

The cathode (24) provides an electroforming mandrel upon which a selected metal may be electrodeposited to produce an electroformed object. The anode (26) is comprised of the selected metal and thus provides a source of the selected metal.

The electrolytic bath (28) is comprised of at least one electrolyte which dissociates into anions and cations in the electrolytic bath (28). The cations are attracted to the cathode (24) and the anions are attracted to the anode (26).

The electrolyte is selected to be compatible with the anode (26). In other words, the cations provided by the electrolyte are cations of the selected metal which is sought to be electrodeposited onto the cathode (24).

As depicted in FIG. 1, the electrolytic cell (20) may be further comprised of one or more insulating shields (30) which shield portions of the cathode (24) in order to prevent electrodeposition of the selected metal onto portions of the cathode (24).

In the operation of the electrolytic cell (20), the power supply (22) is energized to provide the voltage potential between the cathode (24) and the anode (26). The cathode (24) becomes negatively charged and thus attracts cations of the selected metal from the electrolyte. The cations are subjected to reduction at the cathode so that the cations are converted to molecules of the selected metal, which molecules deposit in layers upon the cathode (24).

As reduced cations are deposited onto the cathode (24) and are thus removed from the electrolytic bath (28), they are replaced by cations of the selected metal which are produced by oxidation of molecules of the selected metal from the anode (26).

As a result, as the electrodeposition process progresses, the anode (26) will be gradually consumed due to oxidation at the anode (26) and an increasing thickness of molecules of the selected metal will deposit onto the cathode (24) due to reduction at the cathode (24). The electrodeposition process will continue until a desired thickness of the selected metal is electrodeposited upon the cathode (24) as an electroformed deposit (32) of deposited metal.

Although the thickness of the electroformed deposit (32) will be generally constant throughout the surface area of the cathode (24), a relatively increased thickness will tend to be deposited at edges and corners of the cathode (24) where relatively higher current densities are experienced, and a relatively reduced thickness will tend to be deposited at recesses of the cathode (24) where relatively lower current densities are experienced. These areas of relatively higher and lower current densities are considered in the design and construction of the cathode (24), in order to avoid the result of having areas of the cathode where the current density is extraordinarily high or extraordinarily low during the electrodeposition process.

Referring to FIG. 2, once the desired thickness of the selected metal has been deposited onto the cathode (24), the cathode (24) may be separated from the electroformed deposit (32) to produce an electroformed article (34) which is comprised of the electroformed deposit (32).

In FIG. 2, the cathode (24) is depicted as being separated from the electroformed deposit (32) without damage to or destruction of the cathode (24), with the result that the cathode (24) may conceivably be reused. Alternatively, the cathode (24) may be separated from the electroformed deposit (32) by being dissolved, melted or by being broken. The cathode (24) may also be comprised of a plurality of cathode (24) sections which are independently separated from the electroformed deposit (32) in some manner.

The general method and apparatus of electroforming as depicted in FIG. 1 and FIG. 2 may be adapted for use in the production of a stator for a progressing cavity apparatus according to some embodiments of the invention.

Figure 3:
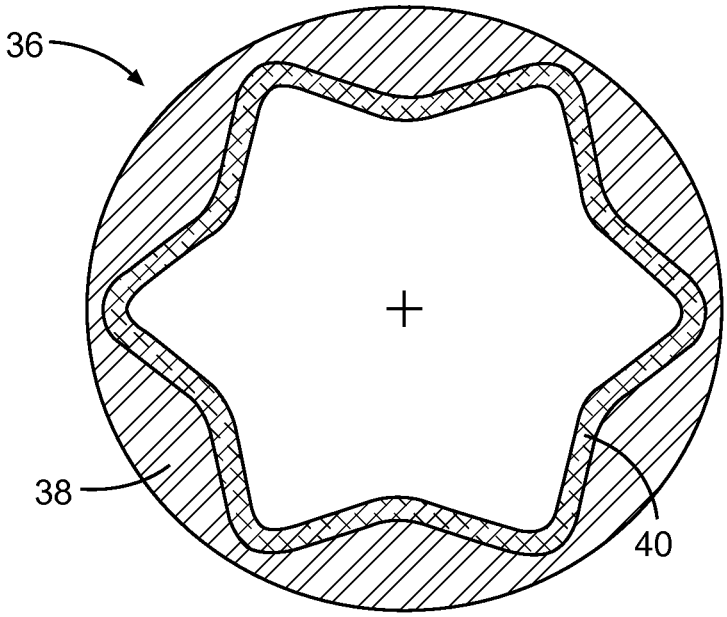
FIG. 3 is a transverse cross-section drawing of a stator for a high performance progressing cavity apparatus comprising a stator tube and an elastomeric lining, wherein the inner surface of the stator tube has a helical lobed tube profile, the outer surface of the stator tube has a substantially cylindrical profile, and the elastomeric lining has a substantially constant thickness.

In some embodiments of the invention, the progressing cavity apparatus is a high performance progressing cavity apparatus. Referring to FIG. 3, a transverse cross-section of an exemplary stator (36) for a high performance progressing cavity apparatus is depicted.

As depicted in FIG. 3, the stator (36) is comprised of a stator tube (38) and an elastomeric lining (40). The elastomeric lining (40) in a high performance progressing cavity apparatus may be optional, depending upon the properties of the stator tube (38) and upon the overall design and configuration of the stator (36).

For example, the elastomeric lining (40) may not be required if the stator tube (38) is sufficiently flexible and resilient to accommodate the movement of the rotor (not shown) within the stator (36) while providing a suitable seal between the rotor and the stator (38), without the assistance of the elastomeric lining (40). The flexibility and resiliency of the stator tube (38) is dependent upon the material properties and thickness of the stator tube (38).

The stator tube (38) has an inner surface (42) which has a helical lobed tube profile. Although six lobes are depicted in FIG. 3, the helical lobed tube profile may include any number of lobes. As depicted in FIG. 3, the stator tube (38) also has an outer surface which has a substantially cylindrical profile. As a result, the stator tube (38) has a varying thickness throughout the transverse cross-section.

As depicted in FIG. 3, the elastomeric lining (40) is comprised of an elastomeric material which has a substantially constant thickness throughout the transverse cross-section. As a result, the stator (36) of FIG. 3 has a helical lobed stator profile which is defined and provided by both the inner surface (42) of the stator tube (38) and the elastomeric lining (40).

As depicted in FIG. 3, the stator tube (38) may be conventionally produced by methods known in the art, such as by rolling, drawing, extruding and hydroforming.

Referring to FIGS. 4-11, stages are depicted of a first embodiment of a method according to the invention for use in producing a stator for a high performance progressing cavity apparatus. FIGS. 4-11 are all transverse cross-section views.

Figure 4:
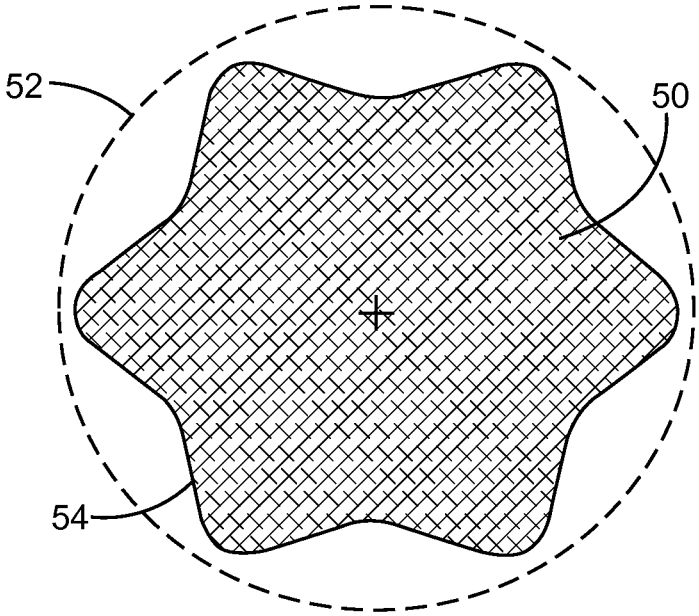
FIG. 4 is a transverse cross-section of a stator tube electroforming mandrel, prepared for use in producing a stator tube using electroforming according to a first embodiment of the invention.

Referring to FIG. 4, a transverse cross-section is depicted of a stator tube electroforming mandrel (50) which may be produced using the same techniques which are used for producing a rotor for a progressing cavity apparatus, including techniques which are well known in the art.

In the first embodiment of the invention the stator tube electroforming mandrel (50) is formed of aluminum or an aluminum alloy and is machined from a cylindrical bar (52) of material. The stator tube electroforming mandrel (50) may be formed as a single piece or may be comprised of a plurality of mandrel sections (not shown). The stator tube electroforming mandrel (50) has an outer surface (54), which outer surface (54) has a helical lobed mandrel profile. Although six lobes are depicted in FIG. 4, the helical lobed mandrel profile may include any number of lobes.

Referring to FIG. 1, the stator tube electroforming mandrel (50) is first incorporated into an electrolytic cell (20) so that the cathode (24) of the electrolytic cell (20) is comprised of the stator tube electroforming mandrel (50).

Figure 5:
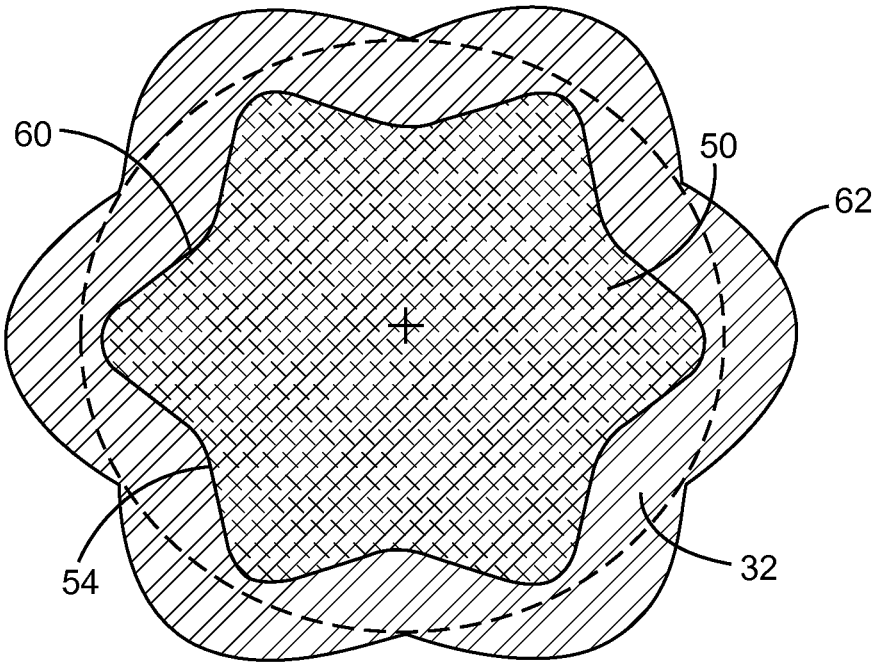
FIG. 5 is a transverse cross-section of the stator tube electroforming mandrel of FIG. 4 and an electroformed deposit of an deposited metal, at a first stage in the production of a stator according to the first embodiment of the invention, wherein the outer surface of the electroformed deposit has a helical lobed profile.

Referring to FIG. 1 and FIG. 5, a thickness of a deposited metal is then electrodeposited onto the stator tube electroforming mandrel (50) in the electrolytic cell (20) as an electroformed deposit (32). In the first embodiment, the electroformed deposit (32) is comprised of nickel, which can typically be electrodeposited successfully in thicknesses of greater than 25 millimeters. In the first embodiment, the electroformed deposit may be further comprised of another metal such as cobalt so that the deposited metal is an alloy comprising nickel and some other metal. For example, the electroformed deposit (32) may be comprised of nickel and cobalt so that the deposited metal is a nickel cobalt alloy.

The electroformed deposit (32) has an inner surface (60) with a helical lobed profile which is complementary to the helical lobed mandrel profile on the outer surface (54) of the stator tube electroforming mandrel (50). As depicted in FIG. 5, the thickness of the electroformed deposit (32) is substantially constant throughout the transverse cross-section, with the result that an outer surface (62) of the electroformed deposit (32) has a helical lobed profile which substantially matches the helical lobed profile on the inner surface (60) of the electroformed deposit (32).

Figure 6:
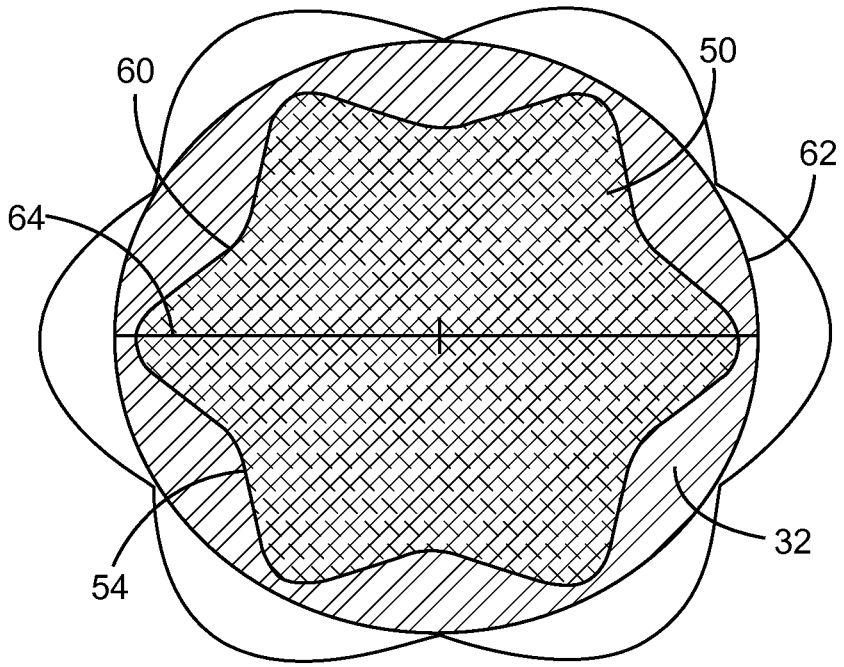
FIG. 6 is a transverse cross-section of the stator tube electroforming mandrel of FIG. 4 and the electroformed deposit of FIG. 5, at a second stage in the production of a stator according to the first embodiment of the invention, wherein the outer surface of the electroformed deposit has been machined so that the outer surface of the electroformed deposit has a substantially cylindrical profile.

Referring to FIG. 6, material is then removed from the outer surface (62) of the electroformed deposit (32), thereby modifying the outer surface (62) in order to provide the electroformed deposit (32) with a desired nominal diameter (64). As depicted in FIG. 6, the outer surface (62) of the electroformed deposit is substantially cylindrical. In the first embodiment, the material is removed from the outer surface (62) of the electroformed deposit (32) by machining the outer surface (62).

Figure 7:
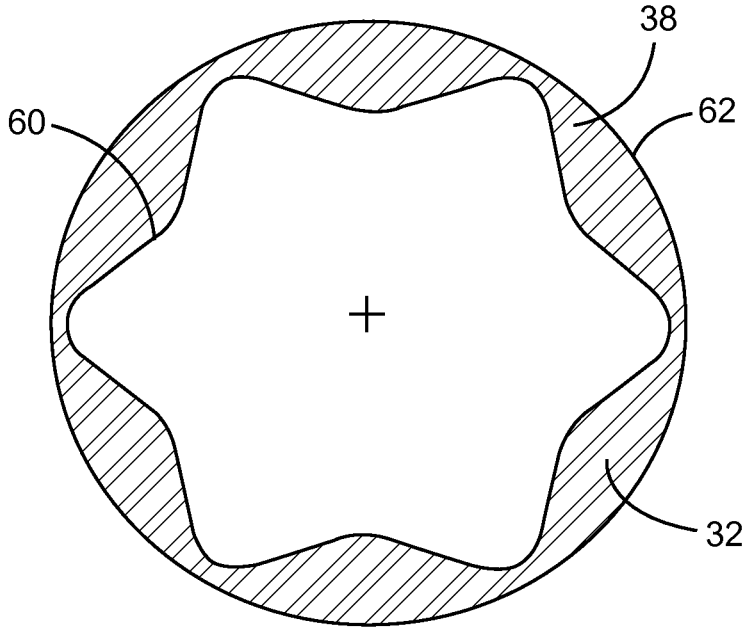
FIG. 7 is a transverse cross-section of a stator tube, at a third stage in the production of a stator according to the first embodiment of the invention, wherein the stator tube is comprised of the electroformed deposit of FIG. 6, and wherein the stator tube electroforming mandrel has been separated from the electroformed deposit in order to produce the stator tube from the electroformed deposit.

Referring to FIG. 7, the stator tube electroforming mandrel (50) is then separated from the electroformed deposit (32), thereby producing a stator tube (38), wherein the stator tube (38) is comprised of the electroformed deposit (32). Following the separation of the stator tube electroforming mandrel (50), the inner surface (60) of the electroformed deposit (32) is the inner surface (60) of the stator tube (38), and the outer surface (62) of the electroformed deposit (32) is the outer surface (60) of the stator tube (38). As a result, the inner surface (60) of the stator tube (38) provides a helical lobed tube profile.

In the first embodiment, the stator tube electroforming mandrel (50) is separated from the electroformed deposit by melting the stator tube electroforming mandrel (50), which is made possible because aluminum and its alloys generally have a much lower melting point than that of nickel and its alloys, such as nickel cobalt alloys.

Figure 8:
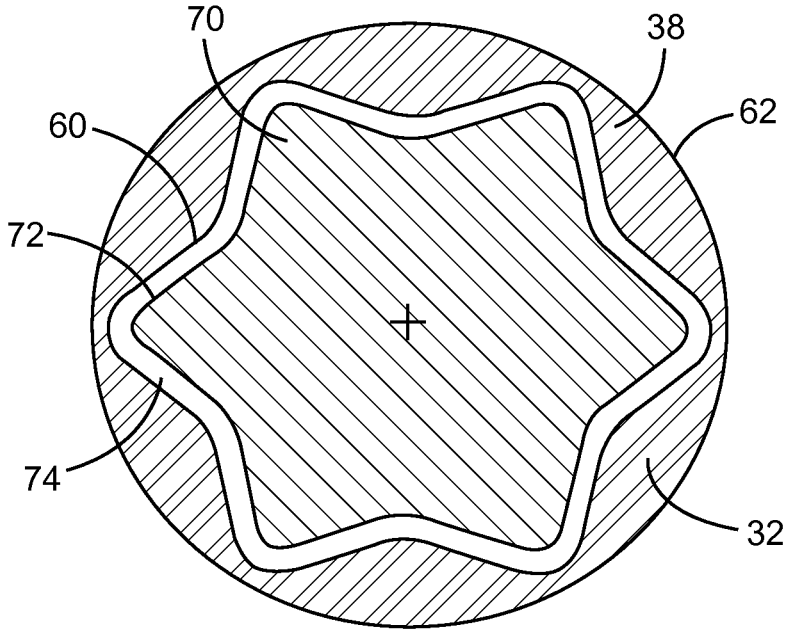
FIG. 8 is a transverse cross-section of the stator tube of FIG. 7 and a form for use in applying an elastomeric lining to the inner surface of the stator tube, at a fourth stage in the production of a stator according to the first embodiment of the invention.

Referring to FIG. 8, a form (70) is then inserted into the stator tube (38) to facilitate the application of an elastomeric lining (40) to the inner surface (60) of the stator tube (38). The form (70) may be constructed of steel or stainless steel and has an outer surface (72) which has a helical lobed profile which matches the helical lobed tube profile on the inner surface (60) of the stator tube (38). A lining space (74) is defined between the inner surface (60) of the stator tube (38) and the outer surface (72) of the form (70). The lining space (74) has a substantially constant width throughout the transverse cross-section of the stator tube (38) and along the length of the stator tube (38).

Figure 9:
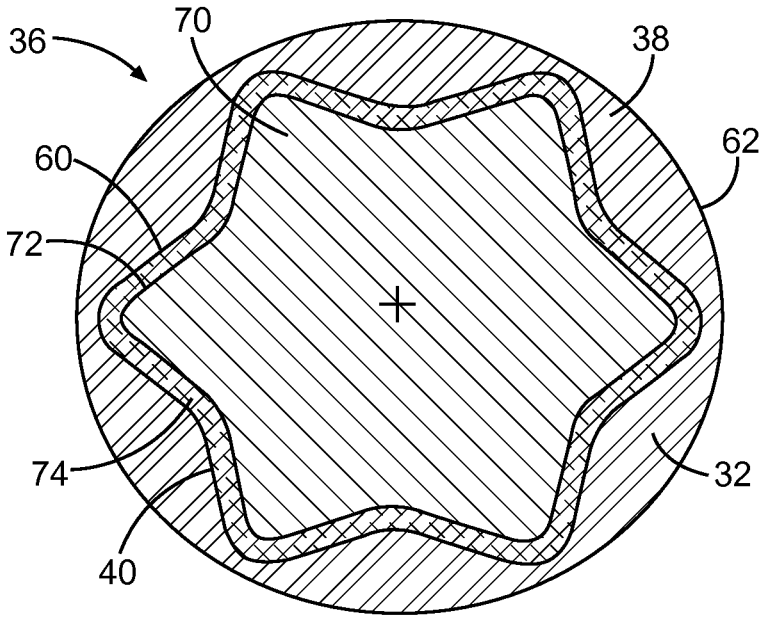
FIG. 9 is a transverse cross-section of the stator tube of FIG. 7, the form of FIG. 8, and an elastomeric lining applied to the inner surface of the stator tube, at a fifth stage in the production of a stator according to the first embodiment of the invention.

Referring to FIG. 9, an elastomeric lining (40) is then applied to the inner surface (60) of the stator tube (38) by injecting an elastomeric material into the lining space (74).

Figure 10:
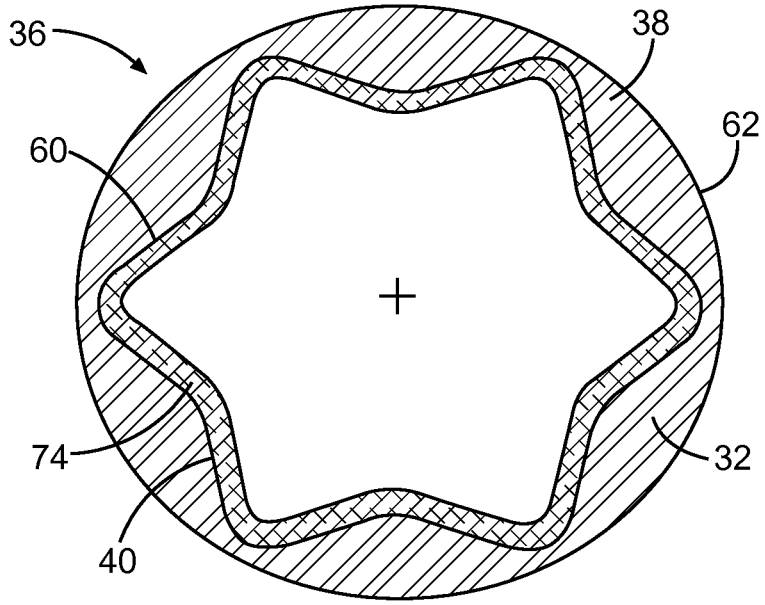
FIG. 10 is a transverse cross-section of the stator tube of FIG. 7 and the elastomeric lining of FIG. 9 following removal from the stator tube of the form of FIG. 8, at a sixth stage in the production of a stator according to the first embodiment of the invention.

Referring to FIG. 10, the form (70) is then removed from the stator tube (38), leaving the elastomeric lining (40) attached to the inner surface (60) of the stator tube (38), wherein the elastomeric lining (40) has a substantially constant thickness throughout the transverse cross-section of the stator tube (38) and along the length of the stator tube (38).

The application of the elastomeric lining (40) is potentially optional and may not be required depending upon the properties of the deposited metal comprising the electroformed deposit (32) and upon the overall design and configuration of the stator (36).

The production of the stator (36) may be completed by performing ancillary processes on the stator tube (38). For example, threaded connections (not shown) may be added to one or both ends (not shown) of the stator tube (38), or other components may be welded or otherwise fastened to the stator tube (38).

Depending upon both the structural properties and the structural requirements of the stator tube (38), the stator (36) may be further comprised of a supporting stator housing for providing structural support for the stator tube (38).

For example, if the deposited metal comprising the stator tube (38) has a relatively low tensile strength and/or modulus of elasticity, or if the stator tube (38) is relatively thin, the supporting stator housing may be necessary or desirable. The use of a supporting stator housing is particularly advantageous if the elastomeric lining (40) is not applied to the inner surface (60) of the stator tube (38), in which case the stator tube (38) will be required to be sufficiently flexible and resilient to accommodate the movement of the rotor within the stator tube (38) and to provide a suitable seal between the rotor and the stator tube (38).

Figure 11:
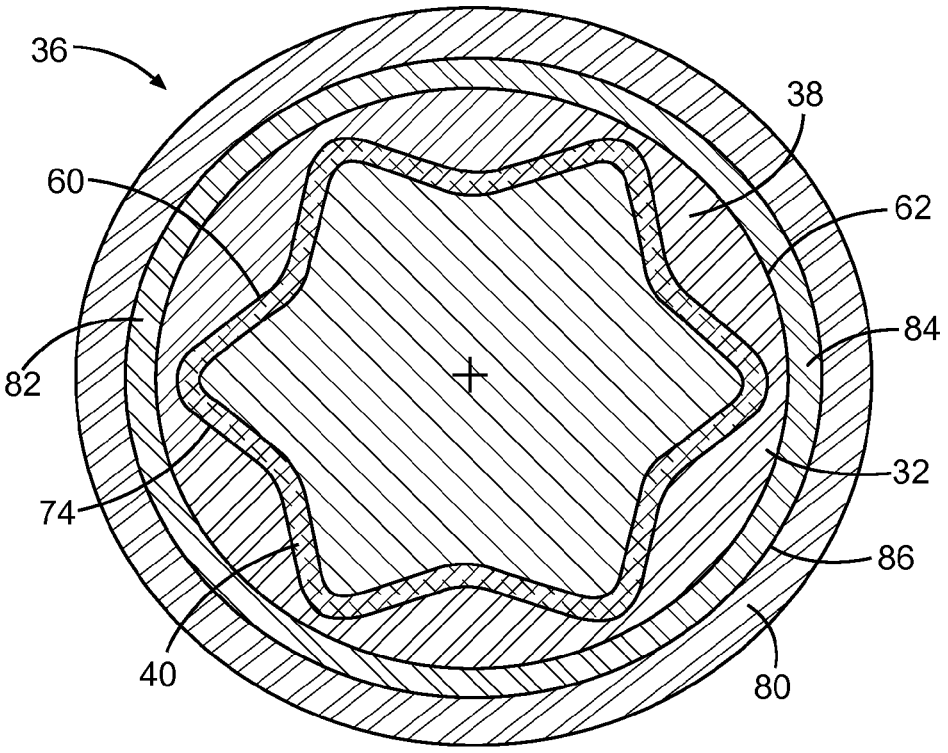
FIG. 11 is a transverse cross-section of the stator tube of FIG. 7, the elastomeric lining of FIG. 9, a supporting stator housing, and a filler material in the annular space between the stator tube and the supporting stator housing, at an optional seventh stage in the production of a stator according to the first embodiment of the invention, wherein a clearance is provided between the stator tube and the supporting stator housing.

Referring to FIG. 11, the stator tube (38) may therefore be mounted within a supporting stator housing (80) and a filler material (82) may be introduced into an annular space (84) defined between the outer surface (60) of the stator tube (38) and an inner surface (86) of the supporting stator housing (80).

In the first embodiment, clearance is provided between the outer surface (60) of the stator tube (38) and the inner surface (86) of the supporting stator housing (80). In the first embodiment, the stator tube (38) is may be mounted within the supporting stator housing (80) using suitable fittings, brackets or connectors at the ends of the stator tube (38) and the supporting stator housing (80) to form joints between the components and by using suitable fasteners or by welding or electrodepositing material at the joints to fasten the stator tube (38) and the supporting stator housing (80) together. Alternatively, the joints at the ends of the stator tube (38) and the supporting stator housing (80) may be formed by providing matching profiles on the outer surface (60) of the stator tube (38) and the inner surface (86) of the supporting stator housing (80).

Consequently, in the first embodiment the stator tube (38) is not directly supported by the supporting stator housing (80) along its length. As a result, if support of the stator tube (38) along its length is desired in the first preferred embodiment, this support may be provided by the introduction of the filler material (82) into the annular space (84).

In the first embodiment, the filler material (82) is comprised of an epoxy cement material or an elastomeric material similar to that which is used for the elastomeric lining (40). The use of an epoxy cement as the filler material (82) may be used where the stator tube (38) must be relatively rigid. An elastomeric material as the filler material (82) may be used where the stator tube (38) may be expected to provide some resilience and flexibility, such as for example if the elastomeric lining (40) is not applied to the stator tube (38).

Referring to FIGS. 12-21, stages are depicted of a second embodiment of a method according to the invention for use in producing a stator for a high performance progressing cavity apparatus. FIGS. 12-21 are all transverse cross-section views.

In the description of the second embodiment of FIGS. 12-21, parts and/or features of the second embodiment which are equivalent to the parts and/or features of the first embodiment of FIGS. 4-11 are given the same reference numbers as were used to describe the first embodiment.

Figure 12:
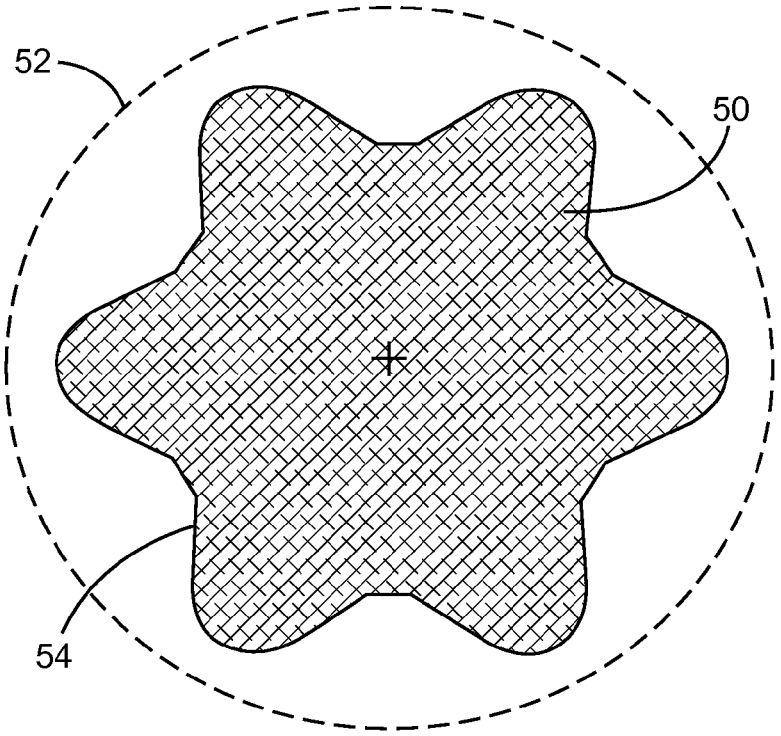
FIG. 12 is a transverse cross-section of a stator tube electroforming mandrel, prepared for use in producing a stator tube using electroforming according to a second embodiment of the invention.

Referring to FIG. 12, a stator tube electroforming mandrel (50) is produced in the same or a similar manner as in the first embodiment. In the second embodiment (as in the first embodiment) the stator tube electroforming mandrel (50) is constructed of aluminum or an aluminum alloy.

Referring to FIG. 1, the stator tube electroforming mandrel (50) is first incorporated into an electrolytic cell (20) so that the cathode (24) of the electrolytic cell (20) is comprised of the stator tube electroforming mandrel (50).

Figure 13:
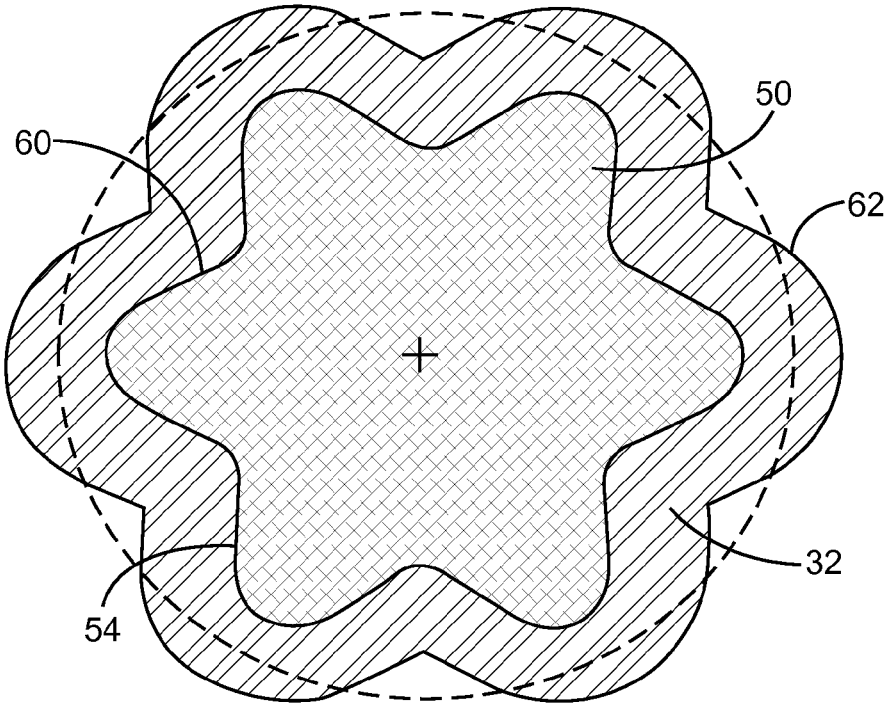
FIG. 13 is a transverse cross-section of the stator tube electroforming mandrel of FIG. 12 and an electroformed deposit of an deposited metal, at a first stage in the production of a stator according to the second embodiment of the invention, wherein the outer surface of the electroformed deposit has a helical lobed profile.

Referring to FIG. 1 and FIG. 13, a thickness of a deposited metal is then electrodeposited onto the stator tube electroforming mandrel (50) in the electrolytic cell (20) as an electroformed deposit (32). In the second embodiment (as in the first embodiment) the electroformed deposit is comprised of nickel and may be further comprised of some other metal so that the deposited metal is comprised of an alloy containing nickel. As in the first embodiment, the other metal may be cobalt so that the deposited metal is comprised of nickel and cobalt as a nickel cobalt alloy.

Figure 14:
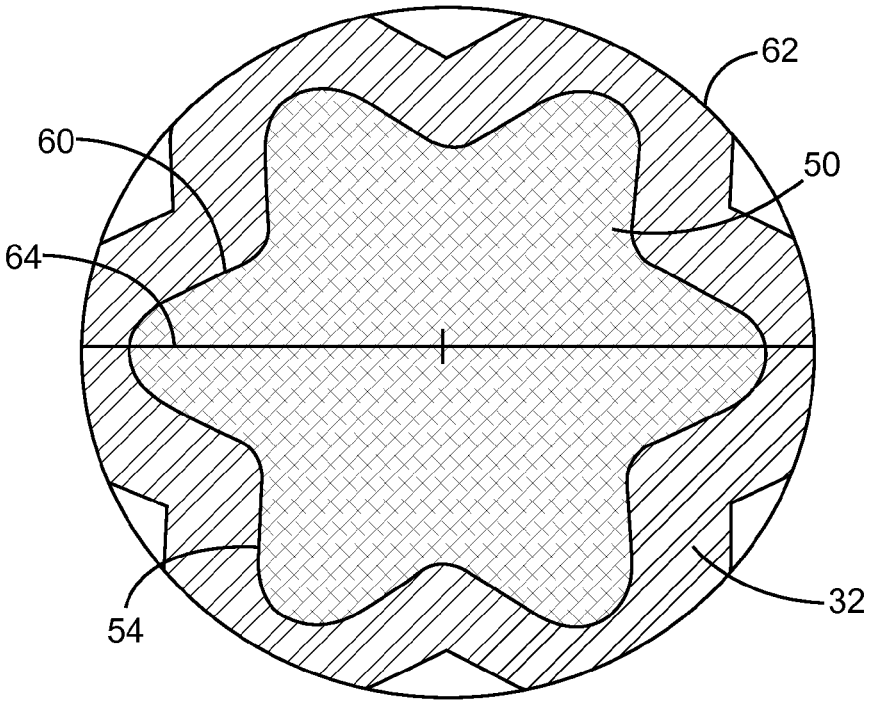
FIG. 14 is a transverse cross-section of the stator tube electroforming mandrel of FIG. 12 and the electroformed deposit of FIG. 13, at a second stage in the production of a stator according to the second embodiment of the invention, wherein the outer surface of the electroformed deposit has been machined to provide a desired nominal diameter.

Referring to FIG. 14, material is then removed from the outer surface (62) of the electroformed deposit (32), thereby modifying the outer surface (62) in order to provide the electroformed deposit (32) with a desired nominal diameter (64). As depicted in FIG. 14, the outer surface (62) of the electroformed deposit retains a portion of the original helical lobed profile. In the second embodiment (as in the first embodiment) the material is removed from the outer surface (62) of the electroformed deposit (32) by machining the outer surface (62).

Figure 15:
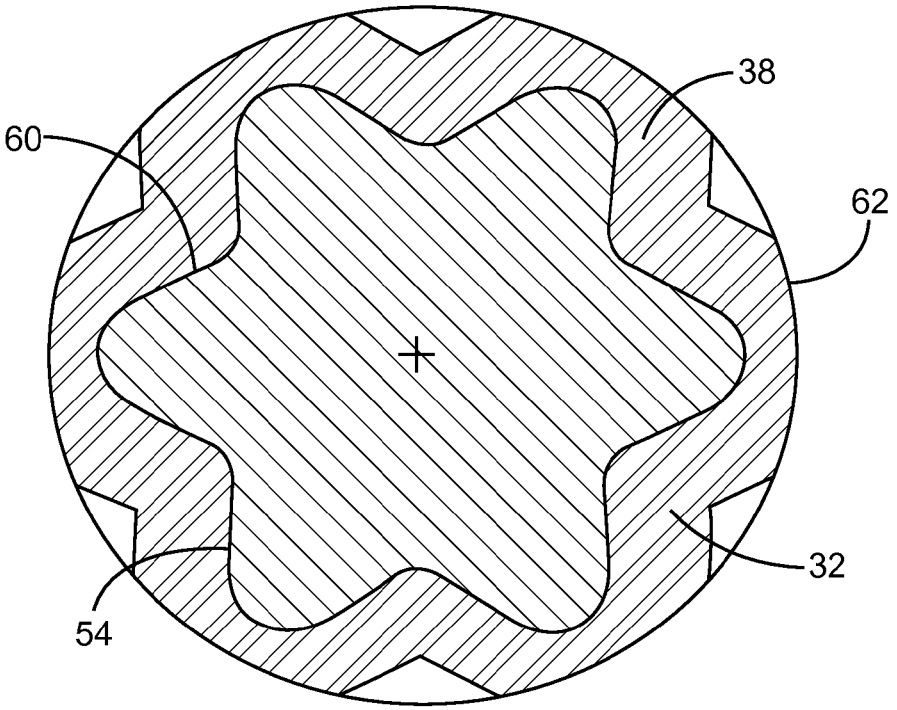
FIG. 15 is a transverse cross-section of a stator tube, at a third stage in the production of a stator according to the second embodiment of the invention, wherein the stator tube is comprised of the electroformed deposit of FIG. 13, and wherein the stator tube electroforming mandrel has been separated from the electroformed deposit in order to produce the stator tube from the electroformed deposit.

Referring to FIG. 15, the stator tube electroforming mandrel (50) is then separated from the electroformed deposit (32), thereby producing a stator tube (38), wherein the stator tube (38) is comprised of the electroformed deposit (32). Following the separation of the stator tube electroforming mandrel (50), the inner surface (60) of the electroformed deposit (32) is the inner surface (60) of the stator tube (38), and the outer surface (62) of the electroformed deposit (32) is the outer surface (60) of the stator tube (38). As a result, the inner surface (60) of the stator tube (38) provides a helical lobed tube profile.

In the second embodiment (as in the first embodiment), the stator tube electroforming mandrel (50) is separated from the electroformed deposit by melting the stator tube electroforming mandrel (50).

Figure 16:
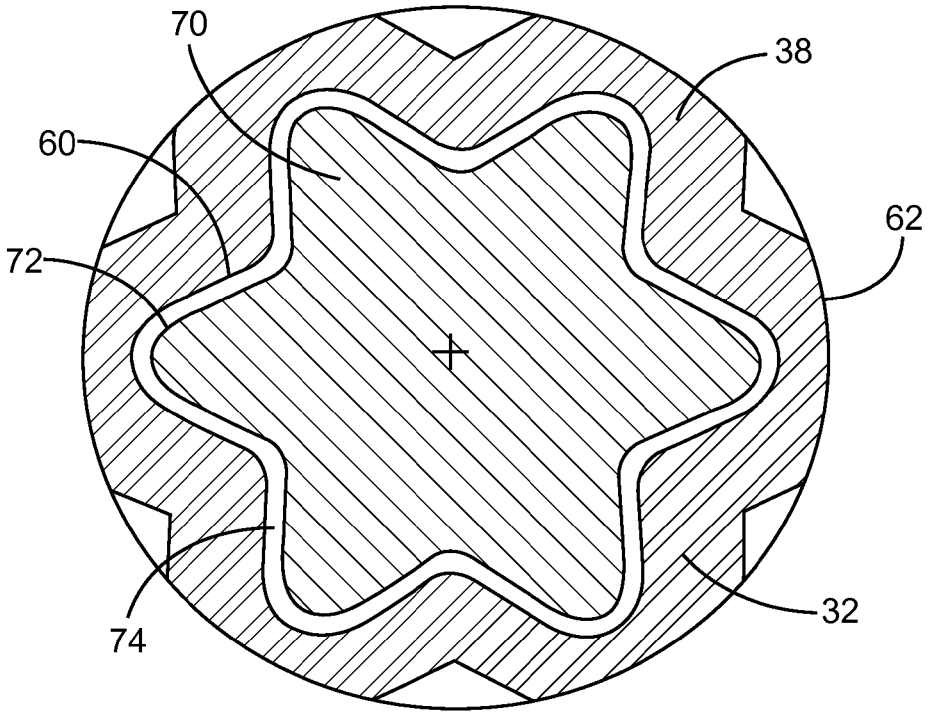
FIG. 16 is a transverse cross-section of the stator tube of FIG. 15 and a form for use in applying an elastomeric lining to the inner surface of the stator tube, at a fourth stage in the production of a stator according to the second embodiment of the invention.

Referring to FIG. 16, a form (70) is then inserted into the stator tube (38) to facilitate the application of an elastomeric lining (40) to the inner surface (60) of the stator tube (38). The form (70) may be constructed of steel or stainless steel and has an outer surface (72) which has a helical lobed profile which matches the helical lobed tube profile on the inner surface (60) of the stator tube (38). A lining space (74) is defined between the inner surface (60) of the stator tube (38) and the outer surface (72) of the form (70). The lining space (74) has a substantially constant width throughout the transverse cross-section of the stator tube (38) and along the length of the stator tube (38).

Figure 17:
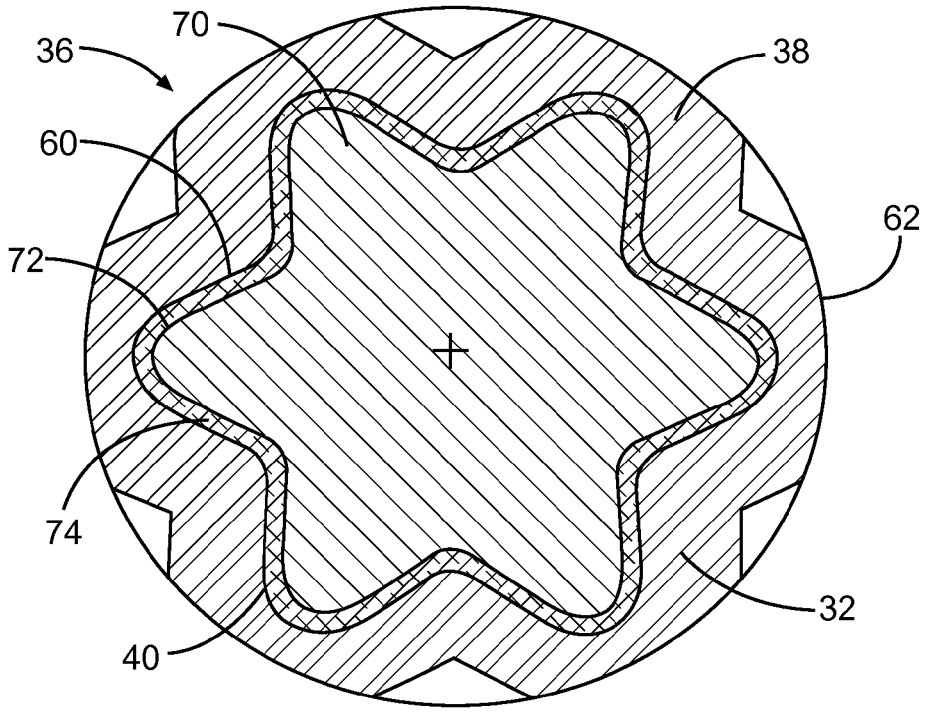
FIG. 17 is a transverse cross-section of the stator tube of FIG. 15, the form of FIG. 16, and an elastomeric lining applied to the inner surface of the stator tube, at a fifth stage in the production of a stator according to the second embodiment of the invention.

Referring to FIG. 17, an elastomeric lining (40) is then applied to the inner surface (60) of the stator tube (38) by injecting an elastomeric material into the lining space (74).

Figure 18:
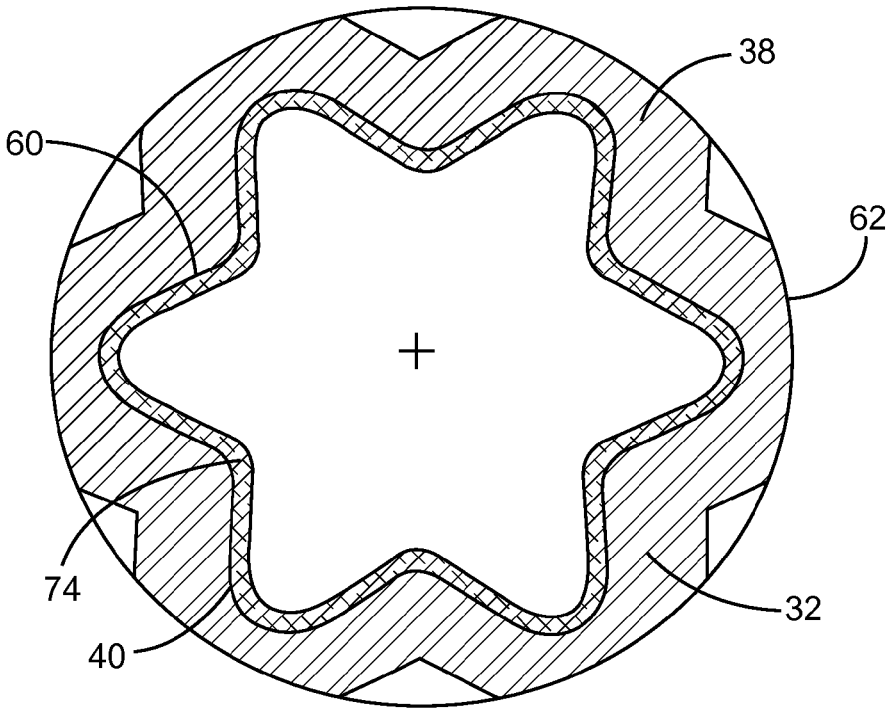
FIG. 18 is a transverse cross-section of the stator tube of FIG. 15 and the elastomeric lining of FIG. 17 following removal from the stator tube of the form of FIG. 16, at a sixth stage in the production of a stator according to the second embodiment of the invention.

Referring to FIG. 18, the form (70) is then removed from the stator tube (38), leaving the elastomeric lining (40) attached to the inner surface (60) of the stator tube (38), wherein the elastomeric lining (40) has a substantially constant thickness throughout the transverse cross-section of the stator tube (38) and along the length of the stator tube (38).

As in the first embodiment, the application of the elastomeric lining (40) is potentially optional and may not be required depending upon the properties of the deposited metal comprising the electroformed deposit (32) and upon the overall design and configuration of the stator (36).

As in the first embodiment, following the application of the elastomeric lining (40), production of the stator (36) may be completed by performing ancillary processes on the stator tube (38). For example, threaded connections may be added to one or both ends of the stator tube (38), or other components may be welded or otherwise fastened to the stator tube (38).

As in the first embodiment, depending upon both the structural properties and the structural requirements of the stator tube (38), the stator (36) may be further comprised of a supporting stator housing for providing structural support for the stator tube (38).

Figure 19:
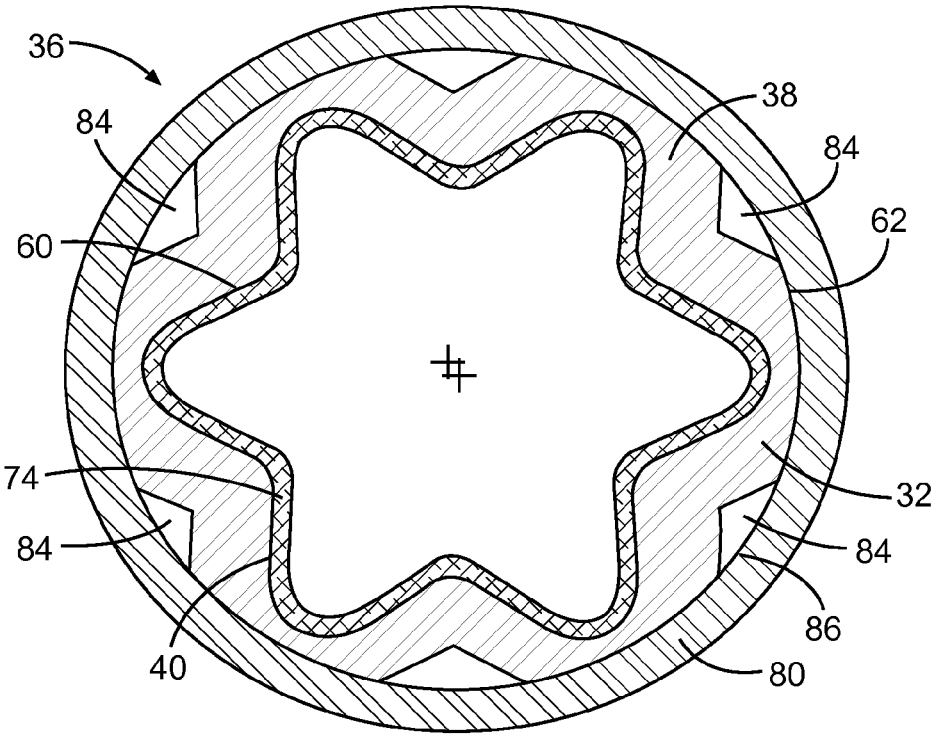
FIG. 19 is a transverse cross-section of the stator tube of FIG. 15, the elastomeric lining of FIG. 17, and a supporting stator housing, at an optional seventh stage in the production of a stator according to the second embodiment of the invention, wherein the stator tube fits closely within the supporting stator housing so that the stator tube is directly supported by the supporting stator housing.

Referring to FIG. 19, there is depicted a first optional stage in the production of the stator (36), in which the stator tube (38) may be optionally mounted within a supporting stator housing (80).

In the second embodiment, the stator tube (38) fits closely within the supporting stator housing (80) so that the stator tube (38) is directly supported along its length by the supporting stator housing (80). The second embodiment is therefore beneficial where it is desirable to inhibit the stator tube (38) from deformation in the radial direction during rotation of the rotor within the stator tube (38). As a result, the second embodiment is particularly well suited for use where the stator (36) includes the elastomeric lining (40) which can accommodate the complex movement of the rotor within the stator tube (38).

In the second embodiment the stator tube (38) may be mounted within the supporting stator housing (80) using a press fit or an interference fit between the stator tube (38) and the supporting stator housing (80).

Figure 20:
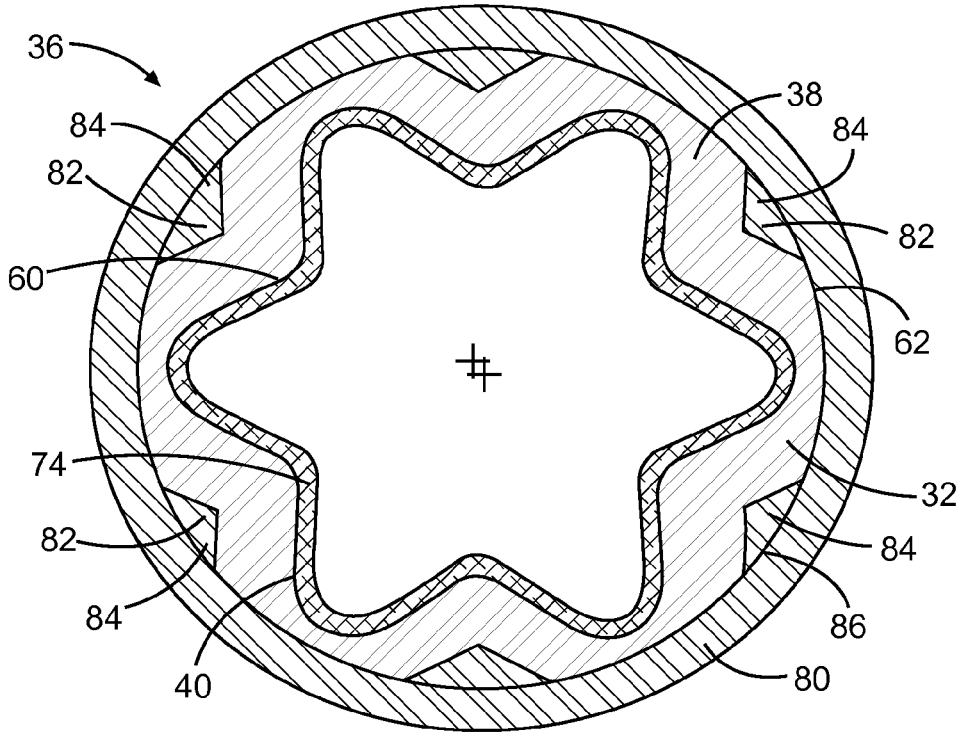
FIG. 20 is a transverse cross-section of the stator tube of FIG. 15, the elastomeric lining of FIG. 17, the supporting stator housing of FIG. 19, and a filler material in the annular space between the stator tube and the supporting stator housing, at an optional eighth stage in the production of a stator according to the second embodiment of the invention.

Referring to FIG. 20, there is depicted a second optional stage in the production of the stator (36), in which a filler material (82) may optionally be introduced into an annular space (84) defined between the outer surface (60) of the stator tube (38) and an inner surface of the supporting stator housing (80). In the second embodiment the filler material (82) is an epoxy cement or an elastomeric material similar to that used for the elastomeric lining (40). In the second embodiment the annular space (84) is comprised of a plurality of unconnected helical spaces which extend along the length of the stator tube (38).

Figure 21:
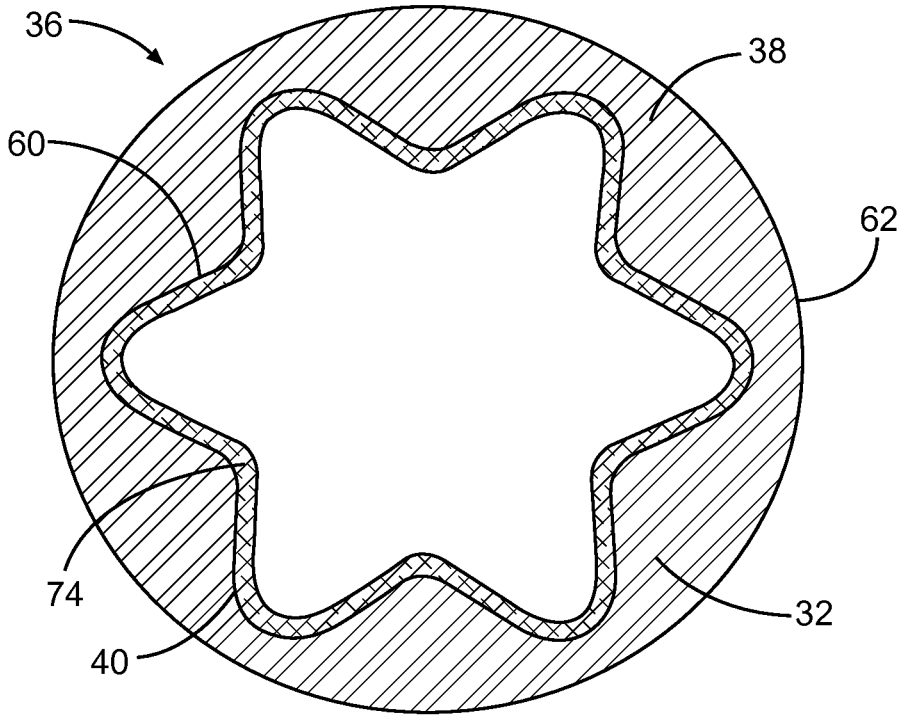
FIG. 21 is a transverse cross-section of an alternate configuration of the stator tube of FIG. 15 and the elastomeric lining of FIG. 17, following the sixth stage in the production of a stator according to the second embodiment of the invention, wherein the outer surface of the stator tube has been machined so that the nominal diameter of the stator tube is a desired nominal diameter, wherein the outer surface of the stator tube has a substantially cylindrical profile, and wherein the stator has sufficient strength and rigidity that a supporting stator housing is not required.

Referring to FIG. 21, there is depicted a transverse cross-section of an alternate configuration of the stator tube (38) and elastomeric lining (40) of FIG. 18. In the alternate configuration, the stator tube (38) has a substantially cylindrical profile on its outer surface (62), but the thickness of the electroformed deposit (32) following modification of the outer surface (62) remains sufficient so that the supporting stator housing (80) is not required. In the alternate configuration, the deposited metal comprising the electroformed deposit (32) is selected to provide physical properties which are suited for use in a self supporting stator tube (38) for a progressing cavity apparatus.

In some embodiments, the method of the invention therefore provides for the use of electroforming in the production of a stator (36) for a progressing cavity apparatus. The progressing cavity apparatus may be a conventional progressing cavity apparatus or a high performance progressing cavity apparatus. The stator (36) may or may not comprise the supporting stator housing (80), depending upon the properties and thickness of the deposited metal of the stator tube (38) and upon the overall design and configuration of the stator (36). In the case of a high performance progressing cavity apparatus, the stator (36) may or may not comprise an elastomeric lining (40), depending upon the properties and thickness of the deposited metal of the stator tube (38) and upon the overall design and configuration of the stator (36).

Although the electroformed deposit (32) in the described embodiments is nickel or an alloy containing nickel (such as a nickel cobalt alloy), any other metals which may be electrodeposited in thicknesses suitable to provide the stator tube (38) may be considered for use in providing the electroformed deposit (32). For example, although copper and its alloys tend to have a significantly lower tensile strength than nickel and its alloys, copper has been reported as having been successfully electrodeposited in thicknesses exceeding about two inches, whereas nickel has been reported as having been successfully electrodeposited in thicknesses exceeding only about one inch. As a result, copper and alloys containing copper may be suitable for use as the electroformed deposit (32), particularly if the stator tube (38) is to be mounted within a supporting stator housing (80) which can provide additional strength and rigidity for the stator (36). The electroformed deposit (32) may therefore conceivably be comprised of a single metal or a plurality of metals electrodeposited sequentially, simultaneously and/or as alloys.

In this document, the word "comprising" is used in its non-limiting sense to mean that items following the word are included, but items not specifically mentioned are not excluded. A reference to an element by the indefinite article "a" does not exclude the possibility that more than one of the elements is present, unless the context clearly requires that there be one and only one of the elements.

What is claimed is:

1. A stator tube for a progressing cavity apparatus, the stator tube comprising:

a single integral metallic tube comprising a cylindrical outer surface and a contoured inner surface; and a substantially constant thickness elastomeric lining formed on and matching the shape of the contoured inner surface of the single integral metallic tube, wherein the single integral metallic tube comprises an electroformed metal deposit and the shape of the contoured inner surface of the single integral tube varies at least one of axially and circumferentially.

2. The stator tube of claim 1, wherein the electroformed metal deposit is comprised of nickel.

3. The stator tube of claim 1, wherein the electroformed metal deposit is comprised of copper.

4. The stator tube of claim 1, wherein the stator tube is configured to be mounted in a supporting stator housing.

5. The stator tube of claim 1, wherein the contoured inner surface comprises a helical lobe surface.

6. A stator for a progressing cavity apparatus, the stator comprising:

a housing; and a stator tube mounted in the housing, the stator tube comprising:

a single integral metallic tube comprising a cylindrical outer surface and a contoured inner surface; and a substantially constant thickness elastomeric lining formed on and matching the shape of the contoured inner surface of the single integral metallic tube, wherein the single integral metallic tube comprises an electroformed metal deposit and the shape of the contoured inner surface of the single integral metallic tube varies at least one of axially and circumferentially.

7. The stator of claim 6, wherein the electroformed metal deposit is comprised of nickel.

8. The stator of claim 6, wherein the electroformed metal deposit comprised of copper.

9. The stator of claim 6, wherein the contoured inner surface comprises a helical lobe surface.

10. The stator of claim 6, wherein an annular space is defined between the stator tube and a supporting stator housing and wherein the annular space is substantially filled with a filler material.

11. The stator of claim 10, wherein the filler material is comprised of an elastomeric material.

12. The stator of claim 10, wherein the filler material is comprised of a cement material.

* * * * *